United States Patent [19]

Young et al.

[11] 4,358,754

[45] Nov. 9, 1982

[54] SOUND-ACTUATED ADVERTISING LIGHT DISPLAY

[75] Inventors: Raymond R. Young, Glenview; Donald F. Buck, Elk Grove Village, both of Ill.

[73] Assignee: Visual Marketing, Inc., Chicago, Ill.

[21] Appl. No.: 267,408

[22] Filed: May 26, 1981

[51] Int. Cl.[3] ..... G08B 5/36

[52] U.S. Cl. ..... 340/815.17; 40/902; 84/464 R; 362/811

[58] Field of Search ..... 340/366 B, 366 A, 366 E; 84/464 R; 40/444, 457, 582, 902, 906; 362/802, 811, 812, 276, 246, 245, 241, 300, 299, 346, 343

[56] References Cited

U.S. PATENT DOCUMENTS

| | | | |
|---|---|---|---|
| 3,754,132 | 8/1973 | Mamrud et al. | 362/346 |
| 3,845,468 | 10/1974 | Smith | 340/366 B |
| 4,265,159 | 5/1981 | Liebman et al. | 340/366 B |

OTHER PUBLICATIONS

Sales brochure entitled "Unique New Products by Decora."

Sales brochure entitled "The Disco Lite Collection by Decora."

*Primary Examiner*—Glen R. Swann, III

*Attorney, Agent, or Firm*—Hume, Clement, Brinks, Willian & Olds, Ltd.

[57] ABSTRACT

A sound-actuated light advertising display (10) includes an octagonally-shaped reflector (20) having an octagonal base (21), outer side walls (22) extending away from the base (21) and projecting at an obtuse angle thereto, and a pyramid-shaped portion (23) extending away from the center of the base (21). A plurality of lights (25) are positioned in the reflector base (21) and are arranged symmetrically with respect to the pyramid-shaped portion (23). A sound-actuated power switching means (27) is connected between the plurality of lights (25) and a power source. The switching means (27) detects sound in the vicinity of the display (10) and regulates power input to the plurality of lights (25) in response to the variations in the level of the detected sound. A prismatically textured translucent cover (15, 19) is positioned over the reflector (20). The cover (15, 19) includes a plate (15) the surface of which defines at least one symbol (16) to be advertised, and a prismatically textured translucent panel (19) which diffuses the light that will pass through the symbol (16). A back panel (12) has the elements of the display (10) mounted thereon; the back panel (12) is in turn adapted for mounting the display (10) in a desired location.

14 Claims, 3 Drawing Figures

FIG. 1
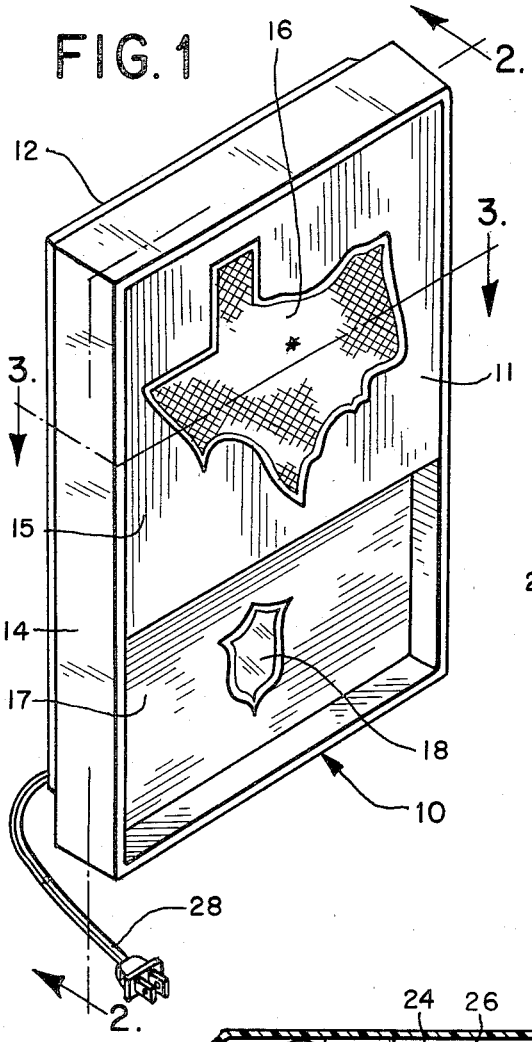
FIG. 2
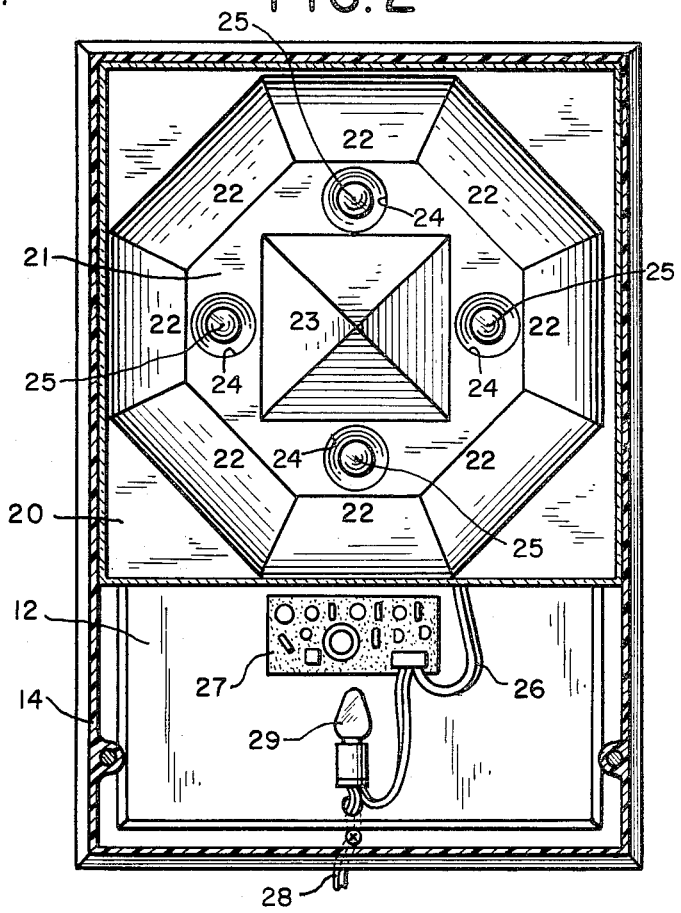
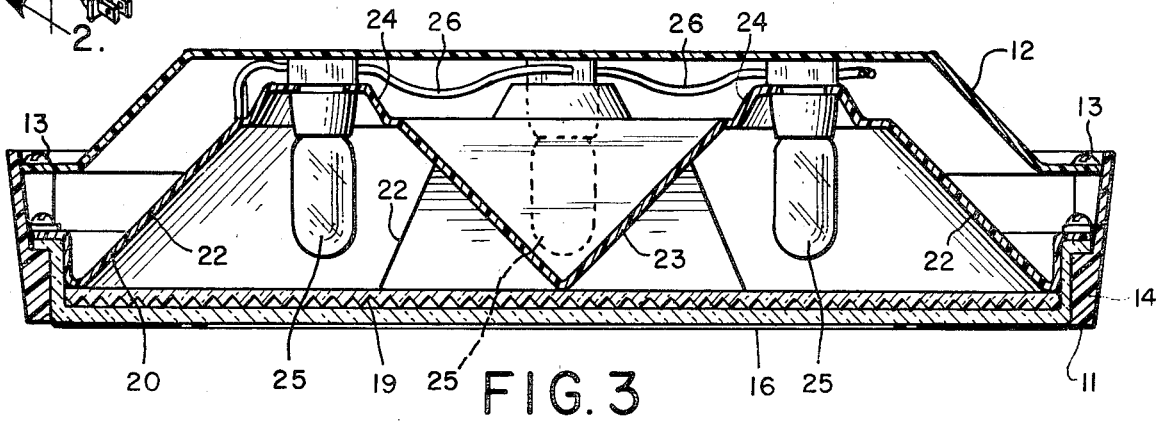
FIG. 3

SOUND-ACTUATED ADVERTISING LIGHT DISPLAY

BACKGROUND OF THE INVENTION

The invention pertains to sound-actuated light displays and lighted symbol displays.

Sound-actuated flashing light units are known to the art. A well-known example of these are color organs which utilize a plurality of colored lights or a color-wheel in conjunction with reflectors to create and project multicolored light patterns. The lights or color-wheel are often connected to a power source across a sound-actuated switch, so that the lights change intensity and flash in synchronization with the detected variation in the volume of sound. Thus the lights will change intensity and flash in unison with for example the beat of music being played in a room.

Lighted symbol displays are also known to the art. They often utilize a light or a series of lights positioned behind a translucent cover which has the symbol to be displayed painted or otherwise defined thereon. Some such displays may have a manual switch for changing the lighting of the display to modify the appearance or the message of the symbol being displayed by the display. The term "symbol" is used throughout the following description to mean a design or verbal message of any shape, form, color or size, however created.

However, lighted symbol displays have not generally been made in the form of sound-actuated light displays, one reason being that the reflectors utilized in sound-actuated flashing units have generally not been suitable for illuminating symbols, such as designs or messages, in a manner conducive to the symbols' being easily seen and recognized, yet such that the lighting and color scheme illuminating the symbol would be interesting and pleasant to look at. Nor have the lighted symbol displays utilized reflectors, and prismatic light diffusing covers for the reflectors, of a configuration suited for use with sound-actuated lights to create illumination for symbols that would be both appealing and interesting to look at, yet provide adequate illumination for the symbol to make it easily perceived and recognized.

SUMMARY OF THE INVENTION

This invention is related to improvements in sound-actuated light displays and lighted symbol displays which avoid the disadvantages of the prior art. In particular, the invention relates to novel sound-actuated light advertising displays.

According to this invention, a sound-actuated light advertising display is created which includes an octagonally-shaped light reflector having an octagonal base, outer side walls extending away from the base and projecting at an obtuse angle thereto, and a pyramid-shaped portion extending away from the center of the base; a plurality of lights positioned in the reflector base and arranged symmetrically around the pyramid-shaped portion; a sound-actuated power switching means connected between the plurality of lights and a power source, for detecting sound in the vicinity of the display and regulating power input to the plurality of lights in response to the variations in the level of the detected sound; a prismatically textured translucent cover positioned over the reflector, the surface of the cover defining at least one symbol to be advertised; and a back panel for mounting the elements of the display thereon the back panel adapted for mounting the display in a desired location.

Preferably, the light reflector is of such size as to wholly overlap the entire symbol or symbols to be illuminated thereby. Preferably, the base line of each face of the pyramid portion of the reflector is parallel to the base line of the reflector side wall which faces that face of the pyramid, and the reflector utilizes four lights for illumination, each light being positioned adjacent to one side of the reflector pyramid and mounted in a substantially cylindrical depression defined by the reflector base. Most preferably, the angle formed by the reflector side walls and the pyramid faces with the reflector base is approximately 135°, and the reflector pyramid extends away from the reflector base approximately as far as the reflector side walls.

A sound-actuated light advertising display as described above avoids the disadvantages of the displays of the prior art. In particular, it provides such illumination for an advertising symbol that the symbol is easily perceived and recognized, yet such that the lighting and color scheme which illuminates the symbol is interesting and pleasant to look at.

Because the display unit is activated by variations in the level of ambient sound in the vicinity of the display, it needs no special wiring or other connections to a source of sound such as a radio, a phonograph, or a jukebox, greatly simplifying the installation as well as relocation of the display.

Furthermore the design of the display in general and of the reflector in particular is simple and thus suited for easy manufacture and, consequently, inexpensive utilization.

These and other advantages of the invention will become apparent during the following description of the presently preferred embodiment of the invention taken in conjunction with the drawings.

BRIEF DESCRIPTION OF THE DRAWINGS

FIG. 1 is a perspective of a preferred embodiment of the sound-actuated light advertising display of this invention;

FIG. 2 is a front view of the display of FIG. 1 with the front cover removed; and FIG. 3 is a sectional view of the display taken along line 3—3 of FIG. 1.

DETAILED DESCRIPTION OF THE PREFERRED EMBODIMENT

Turning now to the drawings, FIG. 1 shows an embodiment of the sound-actuated light advertising display, generally designated as 10. The display 10 has a cover 11 which forms a half-shell, and which is mounted by means of screws 13 (see FIG. 3) to a back panel 12. The back panel 12 also forms a half-shell, and together with the cover 11 it forms a boxlike structure inside which the other components which comprise the display to are located. The back panel 12 has means (not shown) for hanging the display 10 in a desired location. The hanging means may be, for example, slots for nails or hooks.

The cover 11 is comprised of four sections: a side frame 14, a lower face plate 17 which is opaque but for a translucent area 18 which defines a symbol to be advertised, an upper face plate 15 which is opaque but for a transparent area 16 which defines another symbol to be advertised, in this case the general shape of the State of Texas, and a prismatically textured translucent panel 19 (see FIG. 3) which is positioned inside frame 14 over the upper face plate 15. The prismatically textured translucent panel 19 acts to diffuse light that will pass through the transparent symbol area 16. Preferably, the translucent panel 19 is textured on one side only, the other side being substantially smooth and flat. The surface texture of the panel 19 is such that, when illuminated, it reflects multiple images in a manner that enhances the reflectivity of the light source. The particular surface pattern of the translucent panel 19 being utilized helps determine the illumination, and coloring scheme of the transparent symbol area 16. Preferred prismatic patterns include a hexagonal convex pattern, a honeycomb, i.e., an elongated hexagonal convex pattern, and a pyramid prismatic pattern. The pattern utilized can be varied at will, according to application, to obtain different and unusual lighting effects presenting variations in color and illumination. Suitable prismatically textured translucent panels may be obtained from various sources, including Data Display Systems (Division of Decora Industries), 350 E. Tioga St., Philadelphia, Pa. The plates 15 and 17, and the prismatically textured translucent panel 19 are attached to the frame 14 by suitable means, such as brackets and screws.

Turning now to FIGS. 2 and 3, mounted behind the upper face plate 16 is a reflector 20. The reflector 20 is moulded from a single sheet of plastic and has a light-reflecting surface texture. Preferably, the light-reflecting surfaces of the reflector 20 are silver-colored. The reflector 20 is formed in the shape of a parallelogram for easy mounting inside the frame 14; however, the reflecting portion of the reflector 20 is octagonal. The reflector 20 has an octagonal base 21. Extending away from the periphery of the base 21 are eight side walls 22. The side walls 22 project away from the center of the base at an angle of approximately 135°. Extending away from the center of the base 21 is a pyramid-shaped portion 23, whose faces are also inclined to the base 21 at about 135°. As shown in FIG. 3, the pyramid 23 extends away from the base 21 about as far as the side walls 22. The pyramid 23 is oriented such that the base line of each face of the pyramid 23 is parallel to the base line of the reflector side wall 22 which faces that face of the pyramid 23. The base 21 of the reflector 20 defines four substantially cylindrical depressions 24. The depressions 24 are symmetrically located within the base 21, with each one of the depressions 24 being positioned adjacent to one face of the reflector pyramid 23.

Mounted inside each depression 24 is a light 25, comprised of a light bulb and a bulb socket. The lights 25 can be of any color. Preferably, lights of at least two colors are used, for example, two red and two blue lights. The lights 25 illuminate, through the inner plate 19, the advertising symbol area 16 of the upper face plate 15. The illumination is direct as well as indirect, by means of the various surfaces of reflector 20 reflecting the light given off by lights 25 forward onto the upper face plate 15, thereby presenting the appearance of illumination by more than just four lights 25. The configuration of the reflector 20, together with the lights 25, results in such illumination of the advertising symbol area 16 that the symbol is easily perceived and recognized, yet such that the lighting and color scheme thereby created is interesting and pleasant to view.

The lights 25 are connected in parallel by means of lamp cord 26 to a sound-actuated power switching circuit 27 which is mounted to the back panel 12. The circuit 27 in turn has a lamp cord 28 for being connected to a standard A.C. power outlet (not shown).

Sound-actuated switching circuits are known in the art and therefore circuit 27 will not be described here in detail. The particular circuit utilized herein is the No. 155 Circuit Board for Audio Response Illumination for Use With Four 10 W Bulbs, marketed by Data Display Systems, mentioned above. The function of the circuit 27 is to detect sound in the vicinity of the display 10 and to switch on and off the power input to the lights 25 in response to the variations in the volume, or amplitude, of the dectected sound. To respond to the amplitude variations, as opposed to the absolute level of sound, the circuit 27 utilizes an automatic gain control.

Also connected to the lamp cord A.C. power connection 28 is a light 29, which is mounted to the back panel 12 and which is also comprised of a light bulb and a socket. The light 29 illuminates the translucent advertising symbol area 18 of the lower face plate 17. As the light 29 is not connected across the circuit 27, the light 29 is always on whenever the connection to an A.C. power source is made by lamp cord 28.

The cord 28 may have a switch (not shown) mounted thereon for disconnecting A.C. power from the display 10 without need of disconnecting the lamp cord 28 itself from the A.C. power outlet.

To operate the display 10, A.C. power connection is made via lamp cord 28, turning on light 29 and illuminating the advertising symbol area 18 of the lower face plate 17. At the same time, the circuit 27 is powered and it begins to monitor ambient sound in the vicinity of the display 10, turning on and off power to the lights 25 and thus causing those lights to illuminate the advertising symbol area 16 of the upper face plate 15 in an intermittent, or flashing, manner in synchronization with the variations in the volume, or amplitude, of the detected sound. The result is a sound-actuated pulsating light advertising display.

Of course, it should be understood that various changes and modifications to the preferred embodiments described above will be apparent to those skilled in the art. For example, more than one reflector with associated lights may be utilized in a single display. The upper face plate and the prismatically textured panel may be combined into a single plate or panel having a prismatic texture on one side and having an opaque surface on the other side, but for a translucent area defining an advertising symbol. A sound-actuated circuit may be utilized which is not responsive to ambient sound, but only to sound signals fed in by cable. Or the number of lights utilized in the reflector may be varied. These and other changes can be made without departing from the spirit and the scope of the invention, and without diminishing its attendant advantages. It is therefore intended that all such changes and modifications be covered by the following claims.

We claim:

1. A sound-actuated light display, comprising:

an octagonally-shaped light reflector having an octagonal base, outer side walls extending away from the base and projecting at an obtuse angle thereto, and a pyramid-shaped portion extending away from the center of the base;

a plurality of lights positioned in the reflector base and arranged symmetrically with respect to the pyramid-shaped portion;

a sound-actuated power switching means connected between the plurality of lights and a power source, for detecting sound in the vicinity of the display and regulating power input to the plurality of lights in response to the variations in the level of the detected sound;

a prismatically textured translucent cover positioned over the reflector, the surface of the cover defining at least one symbol to be advertised; and a back panel for mounting the reflector, the power switching means and the cover, the back panel adapted for mounting the display in a desired location.

2. The apparatus of claim 1 further comprising at least one light connected to the power source so that the power input to the light is not regulated by said switching means, the light having positioned over it a portion of the translucent cover which defines at least one symbol to be advertised.

3. The apparatus of claim 1 wherein the reflector is silver-colored.

4. The apparatus of claim 1 wherein the number of the plurality of lights is four, each light positioned adjacent to one side of the reflector pyramid.

5. The apparatus of claim 1 wherein the base line of each face of the reflector pyramid is parallel to the base line of the reflector side wall which faces that face of the pyramid.

6. The apparatus of claim 1 wherein the reflector base defines a plurality of substantially cylindrical depressions for mounting the plurality of lights therein.

7. The apparatus of claim 1 wherein the translucent cover is light-diffusing.

8. The apparatus of claim 1 wherein the prismatically textured translucent cover comprises:

a plate having a transparent portion defining the at least one symbol to be advertised; and a prismatically textured translucent panel positioned over the at least one symbol.

9. The apparatus of claim 8 wherein the plate is opaque but for the at least one symbol.

10. The apparatus of claim 8 wherein the prismatically textured translucent panel has a honeycomb convex surface pattern.

11. A sound-actuated light display comprising:

an octagonally-shaped light reflector having an octagonal base, outer side walls rising upwardly from the base and projecting outwardly away from the base at an angle of approximately 135°, and a pyramid-shaped portion extending away from the center of the base such that each faces of the pyramid forms an angle with the base of approximately 135°, the pyramid-shaped portion being approximately as tall as the side walls of the reflector, the pyramid-shaped portion being positioned such that the base line of each face of the pyramid-shaped portion is parallel to the base line of the side wall which faces that face of the pyramid-shaped portion, the base further defining four substantially cylindrical depressions symmetrically arranged around the pyramid-shaped portion;

four lights, each positioned in one of the four substantially cylindrical depressions defined by the reflector base;

a sound-actuated power switching circuit connected between the plurality of lights and a power source, for detecting sound in the vicinity of the display and for switching power to the plurality of lights on and off in response to the variations in the level of the detected sound;

a fifth light connected to the power source positioned adjacent the reflector;

a prismatically textured translucent cover positioned over the reflector and the fifth light, the surface of the cover defining a first symbol to be displayed positioned over the reflector and a second symbol to be displayed positioned over the fifth light; and a back panel for mounting the reflector, the power switching means, the fifth light, and the cover, the back panel adapted for mounting the display in a desired location.

12. The apparatus of claim 11 wherein the prismatically textured translucent cover comprises:

a plate having a transparent portion defining the first symbol to be displayed; and a prismatically textured translucent panel positioned over the first symbol.

13. The apparatus of claim 12 wherein the plate is opaque but for the first symbol.

14. The apparatus of claim 12 wherein the prismatically textured translucent panel has a honeycomb convex surface pattern.

* * * * *

UNITED STATES PATENT AND TRADEMARK OFFICE

CERTIFICATE OF CORRECTION

PATENT NO. : 4,358,754

DATED : November 9, 1982

INVENTOR(S) : Young, et al.

It is certified that error appears in the above-identified patent and that said Letters Patent is hereby corrected as shown below:

Column 2, line 58, delete "to" and insert therefor --10--.

Signed and Sealed this

*Twenty-second* Day of *November 1983*

[SEAL]

*Attest:*

GERALD J. MOSSINGHOFF

*Attesting Officer*

*Commissioner of Patents and Trademarks*